United States Patent [19]

Wirtz et al.

[11] 4,121,649

[45] Oct. 24, 1978

[54] BY-PASS ARRANGEMENT FOR BATTERY GRID CASTING MACHINE

[75] Inventors: John W. Wirtz; Jack E. McLane, both of Port Huron, Mich.

[73] Assignee: Wirtz Manufacturing Company, Inc., Port Huron, Mich.

[21] Appl. No.: 806,722

[22] Filed: Jun. 15, 1977

[51] Int. Cl.[2] ..... B22D 45/00

[52] U.S. Cl. ..... 164/269; 29/527.6

[58] Field of Search ..... 164/269; 271/64; 29/527.5, 527.6, 527.7

[56] References Cited

U.S. PATENT DOCUMENTS

| | | | |
|---|---|---|---|
| 2,107,041 | 2/1938 | Luhrman | 164/269 |
| 2,251,596 | 8/1941 | O'Malley | 193/39 |
| 2,846,046 | 8/1958 | Stempel | 271/64 X |
| 3,861,259 | 1/1975 | Hitch | 271/64 X |

*Primary Examiner*—Richard B. Lazarus

*Attorney, Agent, or Firm*—Barnes, Kisselle, Raisch & Choate

[57] ABSTRACT

A battery grid casting machine including a grid receiving plate located to receive a grid ejected from the grid mold and direct it toward the grid trimming die. The grid receiving plate is movable to a by-pass position for interrupting the flow of grids to the trim die while the grid casting operation continues.

8 Claims, 3 Drawing Figures

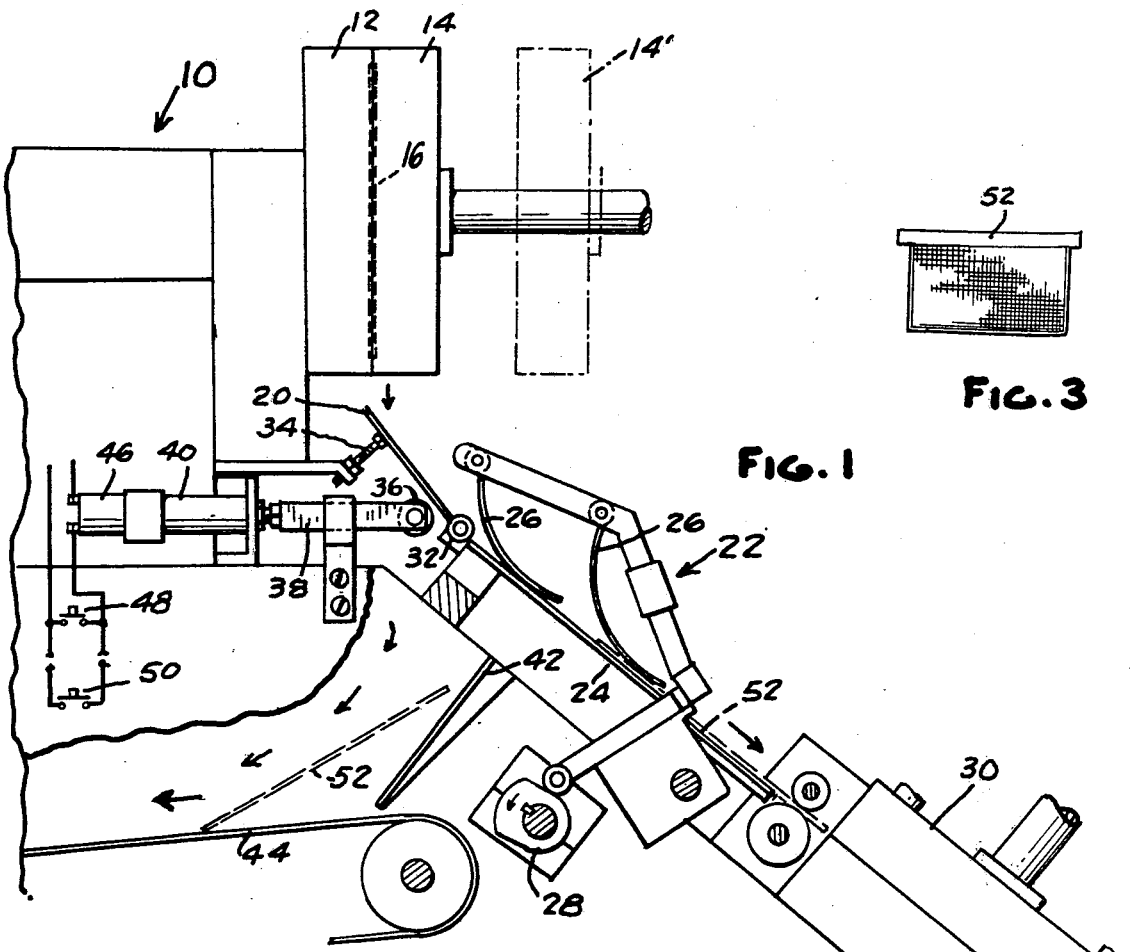
FIG. 1
FIG. 3
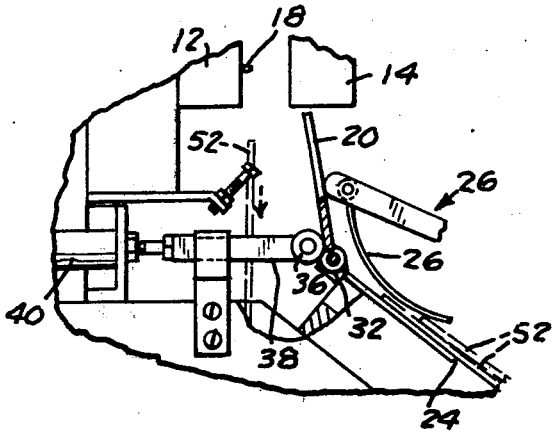
FIG. 2

BY-PASS ARRANGEMENT FOR BATTERY GRID CASTING MACHINE

This invention relates to a battery grid casting machine, and, more particularly, to a grid by-pass arrangement.

In one type of conventional grid casting machine a cast grid is ejected from the grid mold when the latter is opened and drops down onto a guide plate from which the grids are fed one at a time to a grid trimming die. After the grids are trimmed, they are normally conveyed by rails, belts or the like to a downstream location where they are stacked as desired. When a malfunction occurs in the machine at a point downstream of the mold, it normally results in the grids jamming. Normally this requires stopping the casting operation until the malfunction is corrected and the jam eliminated. However, if the casting operation is running smoothly to produce good grids, it is undesirable to stop the casting operation while the machine is being serviced to correct a malfunction because the casting operation when reinitiated may have to be continued for an extended period of time before the proper casting conditions (such as the temperature of the mold, etc.) are again established to produce good grids.

The object of this invention resides in the provision of a by-pass arrangement which enables the casting operation to be continued in the event of a malfunction of the type described, the cast grids being diverted by the by-pass arrangement to a location other than the trimming die.

More specifically, the present invention contemplates the provision of a grid receiving plate located to receive each grid as it is ejected from the mold and directed toward the trimming die when the machine is operating properly. The grid receiving plate is movably mounted on the machine so that it can be displaced to an out-of-the-way or by-pass position in the event of a malfunction of the machine. In this way grids being cast can by-pass the trimming die and be directed to a conveyor arrangement for conveying the grids to another location (for example, back to the lead pot). The means for moving the grid receiving plate to the by-pass position preferably comprises a plurality of switches, one located on each battery grid casting machine and another located at a remote location (such as another battery grid casting machine) so that the grid receiving plate can be actuated to the by-pass position while an operator is located at either the machine at which the malfunction occurs or at another machine.

Other objects, features and advantages of the present invention will become apparent from the following description and accompanying drawing, in which:

FIG. 1 is a fragmentary side elevational view of a battery grid casting machine embodying the present invention;

FIG. 2 is a view of a portion of the machine illustrated in FIG. 1 and showing the grid by-passing arrangement in the actuated position; and FIG. 3 is a plan view of a battery grid.

In FIG. 1 a portion of a battery grid casting machine is generally designated 10. The machine includes a pair of mold half sections 12,14 which, when closed, define a grid cavity 16. In the arrangement illustrated mold section 14 is movable horizontally away from mold section 12, as indicated at 14', for the prupose of ejecting the cast grid from the mold. Ejection of the grid is effected by a plurality of movable ejector pins, one of which is designated 18 in FIG. 2. Below the mold sections 12,14 there is arranged a grid receiving plate 20 which is inclined downwardly toward a guide mechanism 22. The guide mechanism 22 includes a downwardly inclined support plate 24 having a pair of overlying fingers 26 adapted to be intermittently pivoted downwardly into contact with the support plate by a cam 28. Cam 28 is rotated in timed relation with the opening and closing of the mold sections 12,14 so that the grids ejected from the mold and gravitating downwardly onto support plate 24 are properly aligned and intermittently released so as to be directed into a trimming die 30. Trim die 30 is likewise operated in timed relation with the opening and closing of mold sections 12,14.

Grid receiving plate 20 is supported for pivotal movement about a horizontal axis, as at 32. The pivot axis 32 extends transversely of plate 20 at the lower end thereof. The pivot journals at 32 are located laterally outwardly beyond the path of travel of the grid so that the grids slide smoothly from plate 20 onto support plate 24. Grid receiving plate 20 is normally supported in the downwardly inclined position shown in FIG. 1 by means of an adjustable stop 34. Plate 20 is adapted to be pivoted from the grid receiving position shown in FIG. 1 to the grid by-pass position shown in FIG. 2 by means of a roller 36 on the end of a plunger 38 which is reciprocated by a fluid cylinder 40. Stop 34, roller 36 and plunger 38 are offset laterally beyond the path of travel of the grid so as to not interfere with the ability of the grid to drop downwardly behind plate 20 when the latter is in the position shown in FIG. 2 onto a deflector plate 42 which inclines downwardly toward a belt conveyor 44. Conveyor 44 is a scrap conveyor which may extend back to the lead pot for re-melting the grids.

Cylinder 40 is preferably actuated by a solenoid 46. Solenoid 46 is preferably connected to a plurality of switches 48,50 for actuation thereby. For example, switch 48 may be located directly on the machine and switch 50 may be located on a different battery grid casting machine. It is not uncommon for a single operator to supervise the operation of two or three battery grid casting machines at the same time. Thus, if the operator notices a jam or malfunction at a machine other than the one nearest to him, he can actuate a switch such as 50 on the closest machine and thus shift plate 20 on another machine to the by-pass position shown in FIG. 2.

When the machine is operating normally grids 52 are successively cast and ejected from mold sections 12,14. They drop one at a time onto plate 20 and then gravitate onto support plate 24 where their downward movement is momentarily arrested by fingers 26. The fingers 26 rise, permitting the successive grids to properly align themselves and then gravitate to trim die 30 from which the grids are conveyed to a suitable stacking arrangement. However, in the event of a malfunction of a machine, for example, the jamming of two grids 52 on support plate 24 as shown in FIG. 2, the operator simply actuates switch 48 or switch 50 (depending upon which machine he is closest to) to thereby pivot plate 20 to the by-pass position shown in FIG. 2. The machine with the malfunction continues casting grids. The ejected grids then drop vertically downwardly as indicated at 52' in FIG. 2 onto deflector plate 42 and conveyor 44. The operator can then correct the malfunction while the machine continues to cast grids. After the malfunction is corrected the operator switches plate 20 back to the grid receiving position shown in FIG. 1 and the cast grids are then directed in the normal fashion to trim die 30.

We claim:

1. A battery grid casting machine comprising a mold having separable mold half sections which, when closed, define a cavity adapted to be filled with molten metal to form a cast grid, said mold sections being separable to eject the cast grid from the mold cavity and permit it to drop by gravity, grid conveying means located at a level below the mold for conveying grids ejected from the mold toward a grid trimming die on the machine adjacent the downstream end of the conveyor and means for avoiding the necessity of stopping the grid casting and ejecting operations at the mold while the machine is being serviced to correct a malfunction downstream of the mold that requires stopping the flow of grids to the trim die which comprises, a grid receiving plate at the upstream end of the conveying means normally positioned in a downwardly inclined attitude to receive each grid as it is ejected from the mold and direct it downstream to a guide mechanism for feeding the successive grids to the trim die, said grid receiving plate being movable upon the occurence of such malfunction from said grid receiving position to a bypass position wherein it provides a clearance path for the ejected grids which permits them to drop downwardly to a location below said guide mechanism and means for moving said receiving plate between said grid receiving and grid bypassing positions.

2. A battery grid casting machine as called for in claim 1 wherein said means for moving said receiving plate are electrically operated and including switch means for energizing said moving means.

3. A battery grid casting machine as called for in claim 4 wherein said switch means comprise a switch located remotely from said machine.

4. A battery grid casting machine as called for in claim 2 wherein said switch means comprises a first switch located directly adjacent said machine and a second switch located remotely from said machine, either of said switches being adapted to energize said moving means.

5. A battery grid casting machine as called for in claim 1 wherein said grid receiving plate is pivotably supported on said machine.

6. A battery grid casting machine as called for in claim 1 wherein said grid receiving plate is supported on said machine for pivotal movement about a horizontal axis.

7. A battery grid casting machine as called for in claim 6 wherein the pivotal axis of said grid receiving plate extends transversely of the plate at the lower end thereof and said moving means are adapted to pivot the plate upwardly.

8. A battery grid casting machine as called for in claim 1 wherein said receiving plate when in said bypass position is located out of the path of travel of the grids ejected from the mold.

* * * * *

UNITED STATES PATENT AND TRADEMARK OFFICE

CERTIFICATE OF CORRECTION

PATENT NO. : 4,121,649

DATED : OCTOBER 24, 1978

INVENTOR(S) : John W. WIRTZ and Jack E. McLANE

It is certified that error appears in the above-identified patent and that said Letters Patent are hereby corrected as shown below:

Column 4, Line 8 Cancel "4" and insert -- 2 --

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*